US009474363B1

(12) United States Patent
Orsini

(10) Patent No.: US 9,474,363 B1
(45) Date of Patent: Oct. 25, 2016

(54) PORTABLE STANDING DESK DEVICE HAVING X-SHAPED BASE

(71) Applicant: Jean-Francois Orsini, Washington, DC (US)

(72) Inventor: Jean-Francois Orsini, Washington, DC (US)

( * ) Notice: Subject to any disclaimer, the term of this patent is extended or adjusted under 35 U.S.C. 154(b) by 0 days.

(21) Appl. No.: 15/163,928

(22) Filed: May 25, 2016

(51) Int. Cl.
*A47B 13/00* (2006.01)
*A47B 3/06* (2006.01)
*A47B 13/02* (2006.01)

(52) U.S. Cl.
CPC ..... *A47B 3/06* (2013.01); *A47B 13/003* (2013.01); *A47B 13/02* (2013.01)

(58) Field of Classification Search
CPC ..... A47B 3/02; A47B 3/06; A47B 13/003
USPC ..... 108/157.15, 157.16, 157.17, 157.18, 108/158.12, 159
See application file for complete search history.

(56) References Cited

U.S. PATENT DOCUMENTS

| | | | | | |
|---|---|---|---|---|---|
| 432,425 | A * | 7/1890 | Moan | A47B 3/12 | 108/159 |
| 1,393,679 | A * | 10/1921 | Forster | A47B 3/12 | 108/158.12 |
| 2,481,671 | A * | 9/1949 | John | A47B 3/06 | 108/101 |
| 2,628,668 | A * | 2/1953 | Basile | A47C 4/021 | 108/159 |
| 2,911,108 | A * | 11/1959 | Nield | A47B 5/04 | 108/152 |
| 3,633,519 | A * | 1/1972 | Nichol | A47C 9/10 | 108/159 |
| 4,084,517 | A * | 4/1978 | Guess | A47B 3/06 | 108/158.12 |
| 4,267,998 | A * | 5/1981 | Weirich | A47B 3/06 | 108/158.12 |
| 4,379,432 | A * | 4/1983 | Grossman | A47F 5/04 | 108/159 |
| 4,740,032 | A * | 4/1988 | Olsen | A47B 3/06 | 108/159 |
| 5,644,995 | A * | 7/1997 | Gurwell | A47B 3/12 | 108/158.12 |
| 5,658,086 | A * | 8/1997 | Brokaw | A47B 13/003 | 144/354 |
| 6,205,936 | B1 * | 3/2001 | Nelson | A47C 4/021 | 108/157.1 |
| 6,553,920 | B1 * | 4/2003 | Galtieri | A47B 3/06 | 108/63 |
| 6,595,143 | B2 * | 7/2003 | London | A47D 3/00 | 108/25 |
| 6,827,028 | B1 * | 12/2004 | Callaway | A47B 3/06 | 108/157.1 |
| 2003/0205180 | A1 * | 11/2003 | Bishop | A47B 3/06 | 108/158.12 |
| 2006/0284469 | A1 * | 12/2006 | Lowsky | A47B 13/003 | 297/440.1 |
| 2008/0245277 | A1 * | 10/2008 | Willy | A47B 3/06 | 108/28 |
| 2008/0245281 | A1 * | 10/2008 | Willy | A47B 13/003 | 108/157.16 |
| 2014/0165289 | A1 * | 6/2014 | Trocchia | A47D 1/006 | 5/131 |
| 2014/0373357 | A1 * | 12/2014 | Elliott | B23P 11/00 | 29/897 |
| 2015/0076871 | A1 * | 3/2015 | Werner | A47C 9/10 | 297/135 |
| 2015/0305491 | A1 | 10/2015 | Orsini | | |

* cited by examiner

*Primary Examiner* — Hanh V Tran
(74) *Attorney, Agent, or Firm* — Chen-Chi Lin

(57) ABSTRACT

A portable standing desk device has a top board, four block assemblies each having a groove, a first base panel, and a second base panel. The first base panel has an open ended slot extending upwardly from a bottom surface of the base panel. The second base panel has an open ended slot extending downwardly from a top surface of the base panel. The open ended slots may be strengthened by U-shaped reinforcing elements. In an assembled condition, the first base panel and the second base panel form a base having a letter X shape. The first base panel and the second base panel may be coupled with angle adjusters to be assembled with different top boards having different sets of block assemblies. In a storage condition, the portable standing desk device is compactly packed.

13 Claims, 8 Drawing Sheets

PORTABLE STANDING DESK DEVICE HAVING X-SHAPED BASE

INCORPORATION BY REFERENCE

U.S. Patent Application Publication Number 20150305491A1 is hereby incorporated by reference.

FIELD OF THE INVENTION

This invention relates generally to a portable standing desk device. More particularly, the present invention relates to a portable standing desk device having an X-shaped base.

BACKGROUND OF THE INVENTION

U.S. Patent Application Publication Number 20150305491A1 discloses a light, foldable and portable standing desk device having a plurality of base panels forming an enclosure having a shape of a multi-pointed star. The present disclosure uses two base panels to form an X-shaped base.

SUMMARY OF THE INVENTION

This invention discloses a portable standing desk device comprising a top board, four block assemblies each having a groove, a first base panel, and a second base panel. The first base panel has an open ended slot extending upwardly from a bottom surface of the base panel. The second base panel has an open ended slot extending downwardly from a top surface of the base panel. The open ended slots may be strengthened by U-shaped reinforcing elements. In an assembled condition, the first base panel and the second base panel form a base having a letter X shape. The first base panel and the second base panel may be coupled with angle adjusters to be assembled with different top boards having different sets of block assemblies. In a storage condition, the portable standing desk device is compactly packed.

DETAILED DESCRIPTION OF THE INVENTION

Figure 1:
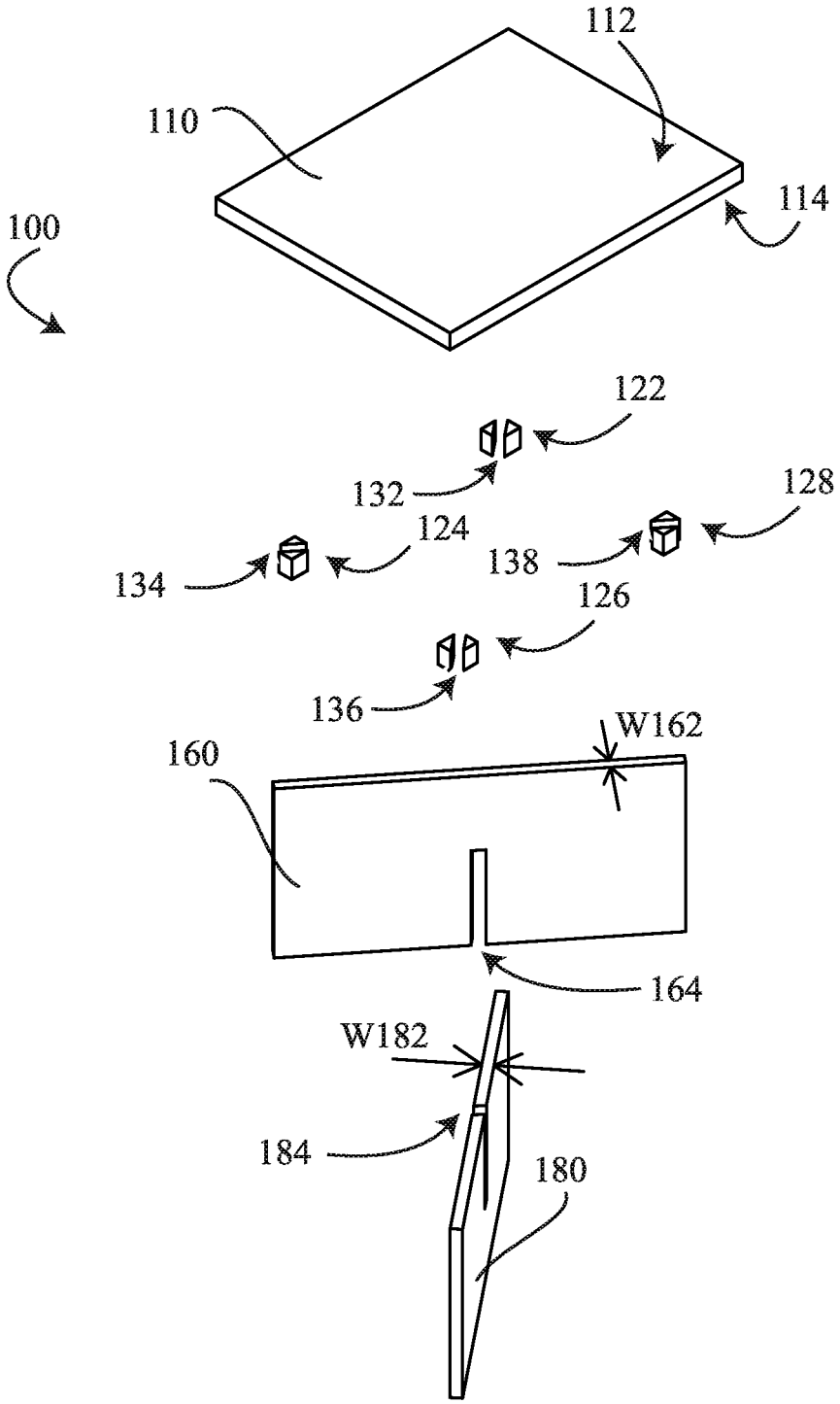
FIG. 1 is an exploded view of a portable standing desk device in examples of the present disclosure.
Figure 2:
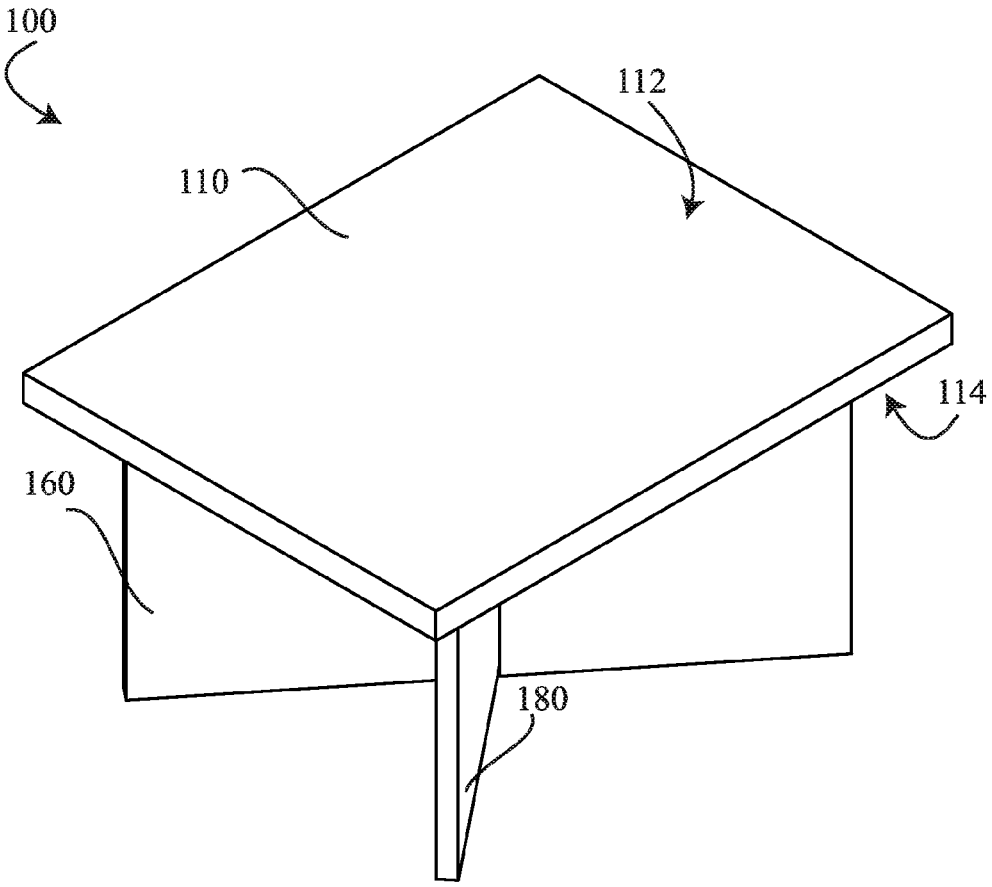
FIG. 2 is a schematic perspective view of the portable standing desk device of FIG. 1 in an assembled condition in examples of the present disclosure.
Figure 3:
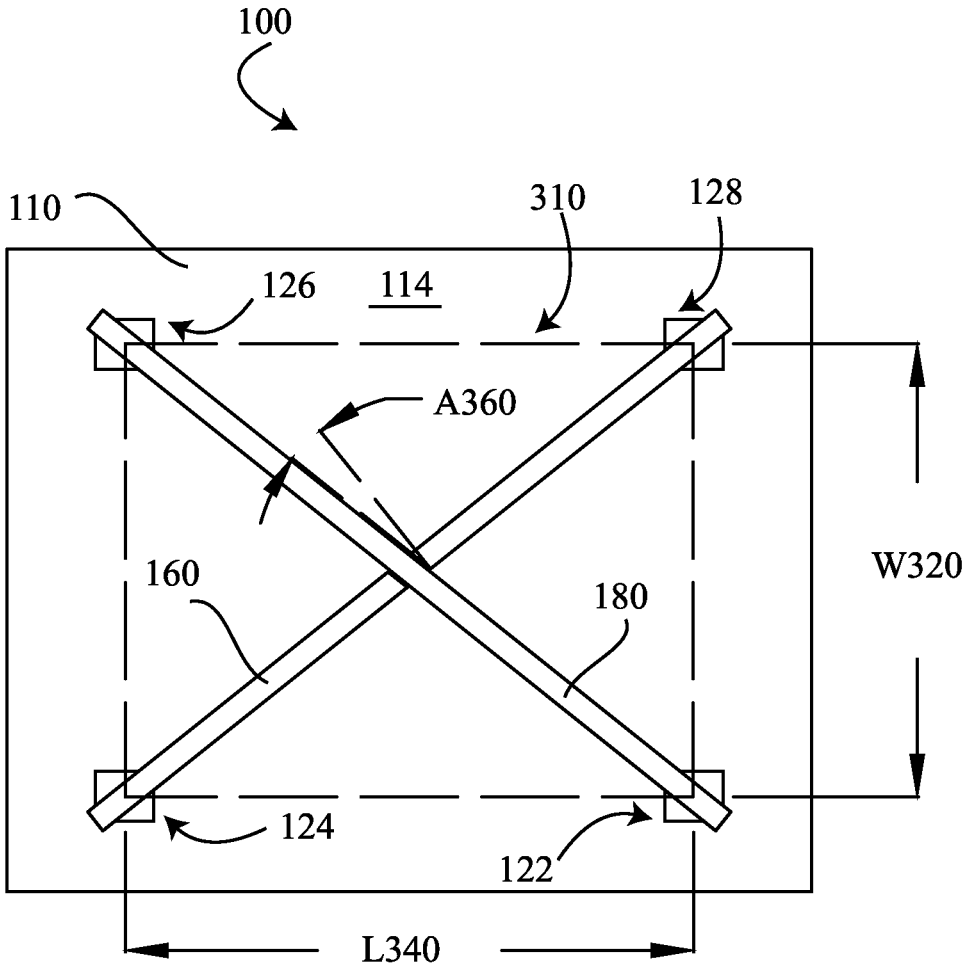
FIG. 3 is a bottom view of the portable standing desk device of FIG. 2 in examples of the present disclosure.
Figure 4:
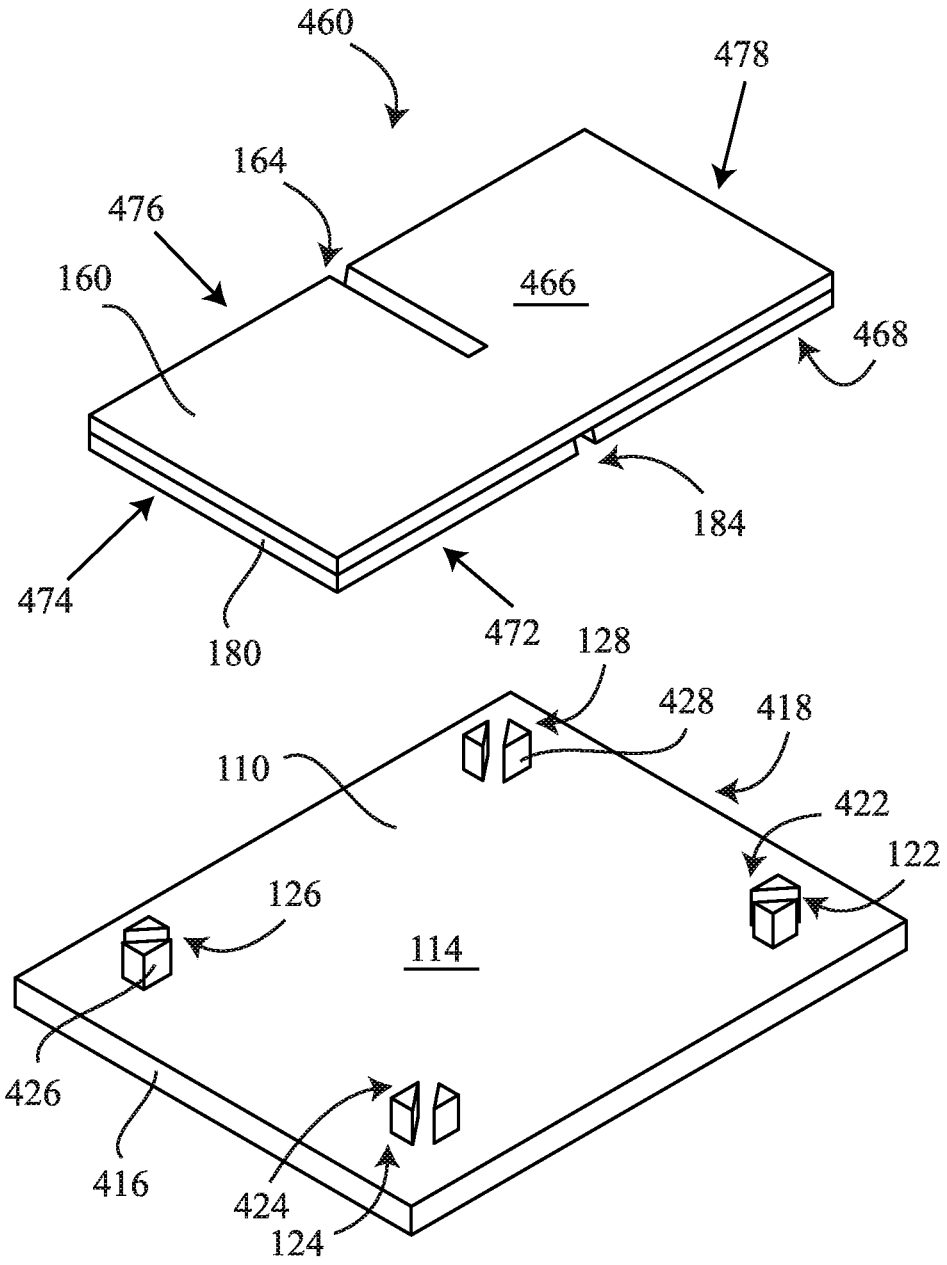
FIG. 4 is a schematic perspective view of the portable standing desk device of FIG. 1 in a condition between the assembled condition and a storage condition in examples of the present disclosure.

FIG. 1 is an exploded view, FIG. 2 is a schematic perspective view, and FIG. 3 is a bottom view of a portable standing desk device 100 in examples of the present disclosure. The portable standing desk device 100 comprises a top board 110, a first block assembly 122 having a first groove 132, a second block assembly 124 having a second groove 134, a third block assembly 126 having a third groove 136, a fourth block assembly 128 having a fourth groove 138, a base panel 160, and another base panel 180. The top board 110 has a top surface 112 and a bottom surface 114. In FIG. 4, a second side surface 418 of the top board 110 is opposing the first side surface 416 of the top board 110. In FIGS. 1-3, top surfaces of the first block assembly 122, the second block assembly 124, the third block assembly 126, and the fourth block assembly 128 are attached to the bottom surface 114 of the top board 110. The base panel 160 has an open ended slot 164 extending upwardly from a bottom surface of the base panel 160. The base panel 180 has an open ended slot 184 extending downwardly from a top surface of the base panel 180. In one example, each of the open ended slot 164 and the open ended slot 184 is a slanted cut done by an angled rotary blade.

In one example, the top board 110, the four separated block assemblies 122, 124, 126, and 128, and the base panels 160 and 180 are made of paper boards. In another example, the top board 110, the four separated block assemblies 122, 124, 126, and 128, and the base panels 160 and 180 are made of a plastic material.

In one example, the four separated block assemblies 122, 124, 126, and 128 are glued to the top board 110. In another example, the four separated block assemblies 122, 124, 126, and 128 are nailed to the top board 110. In still another example, the four separated block assemblies 122, 124, 126, and 128 are attached to the top board 110 by tapes. In one example, each of the four separated block assemblies 122, 124, 126, and 128 is a two-piece constructed assembly. A first piece and a second piece are separated by a groove. In another example, each of the four separated block assemblies 122, 124, 126, and 128 is a one-piece constructed assembly. A single piece having a groove in a middle region facing downwardly.

In examples of the present disclosure, the base panel 160 and the base panel 180 have the same length, width, and thickness. The first open ended slot 164 and the second open ended slot 184 have the same length, width, depth and angle. In one example, the length of the base panel 160 is the same as the diagonal length of the bottom surface 114 of the top board 110. In another example, the length of the base panel 160 is shorter than the diagonal length of the bottom surface 114 of the top board 110.

In examples of the present disclosure, a length of the first open ended slot 164 is longer than a half of a height of the base panel 160 and a length of the second open ended slot 184 is longer than a half of a height of the base panel 180.

The base panel 160 has a width W162. The base panel 180 has a width W182. In examples of the present disclosure, the width W162 is the same as the width W182. In one example, the width W182 is smaller than a width of the second groove 134. In another example, the width W182 is the same as the width of the second groove 134. The four grooves 132, 134, 136, and 138 hold the base panels 160 and 180 by friction. In still another example, the width W182 is larger than the width of the second groove 134 and, in an assembled condition, a portion of the base panel 160 is press-fitted into the second groove 134. Another portion of the base panel 160 is press-fitted into the fourth groove 138. A portion of the base panel 180 is press-fitted into the first groove 132. Another portion of the base panel 180 is press-fitted into the third groove 136.

In examples of the present disclosure, during an assembling process, the first open ended slot 164 is aligned vertically with the second open ended slot 184. The base panel 160 slides downwardly and interlocks with the base panel 180. Therefore, in an assembled condition, the base panel 160 and the base panel 180 form a base having a letter X shape.

In examples of the present disclosure, in an assembled condition, a top surface of the base panel 160 and a top surface of the base panel 180 contact the bottom surface 114 of the top board 110.

In FIG. 3, a center of the first groove 132 of the first block assembly 122, a center of the second groove 134 of the second block assembly 124, a center of the third groove 136 of the third block assembly 126, and a center of the fourth groove 138 of the fourth block assembly 128 are located at four corners of an imaginary rectangle 310. The first groove 132 and the third groove 136 are diagonally opposed. The second groove 134 and the fourth groove 138 are diagonally opposed. The imaginary rectangle 310 has a length L340 and a width W320. A slenderness ratio of the imaginary rectangle 310 is represented by the length L340 divided by the width W320. An acute angle A360 in degrees between a normal direction of a side surface of the base panel 160 and a first side wall of the open ended slot 164 is determined by a mathematical expression $\{2\times[\text{arctangent}(L/W)\times 180/\pi]-90\}$. L is the length L340. W is the width W320. $\pi$ is a mathematical constant, a ratio of a circle's circumference to a diameter of the circle. Arctangent is an inverse trigonometric function. In one example, L is larger than W. In one example, L is 100 centimeters. W is 80 centimeters. A360 is 12.68 degrees. In another example, L is 100 centimeters. W is 70 centimeters. A360 is 20.02 degrees. In one example, a properly determined acute angle A360 provides a tighter grip between the base panels 160 and 180.

FIG. 4 is a schematic perspective view of the portable standing desk device of FIG. 1 in a condition between the assembled condition and a storage condition in examples of the present disclosure. A side surface of the base panel 160 contacts another side surface of the base panel 180 so as to form a base panel stack 460. In one example, the base panel 160 is on top of the base panel 180. In another example, the base panel 180 is on top of the base panel 160. The side surface of the base panel 160 may be either one of the opposing larger side surfaces. The other side surface of the base panel 180 may be either one of the opposing larger side surfaces. The base panel stack 460 has opposing surfaces 466 and 468. The base panel stack 460 has opposing surfaces 472 and 476. The base panel stack 460 has opposing surfaces 474 and 478.

Figure 5:
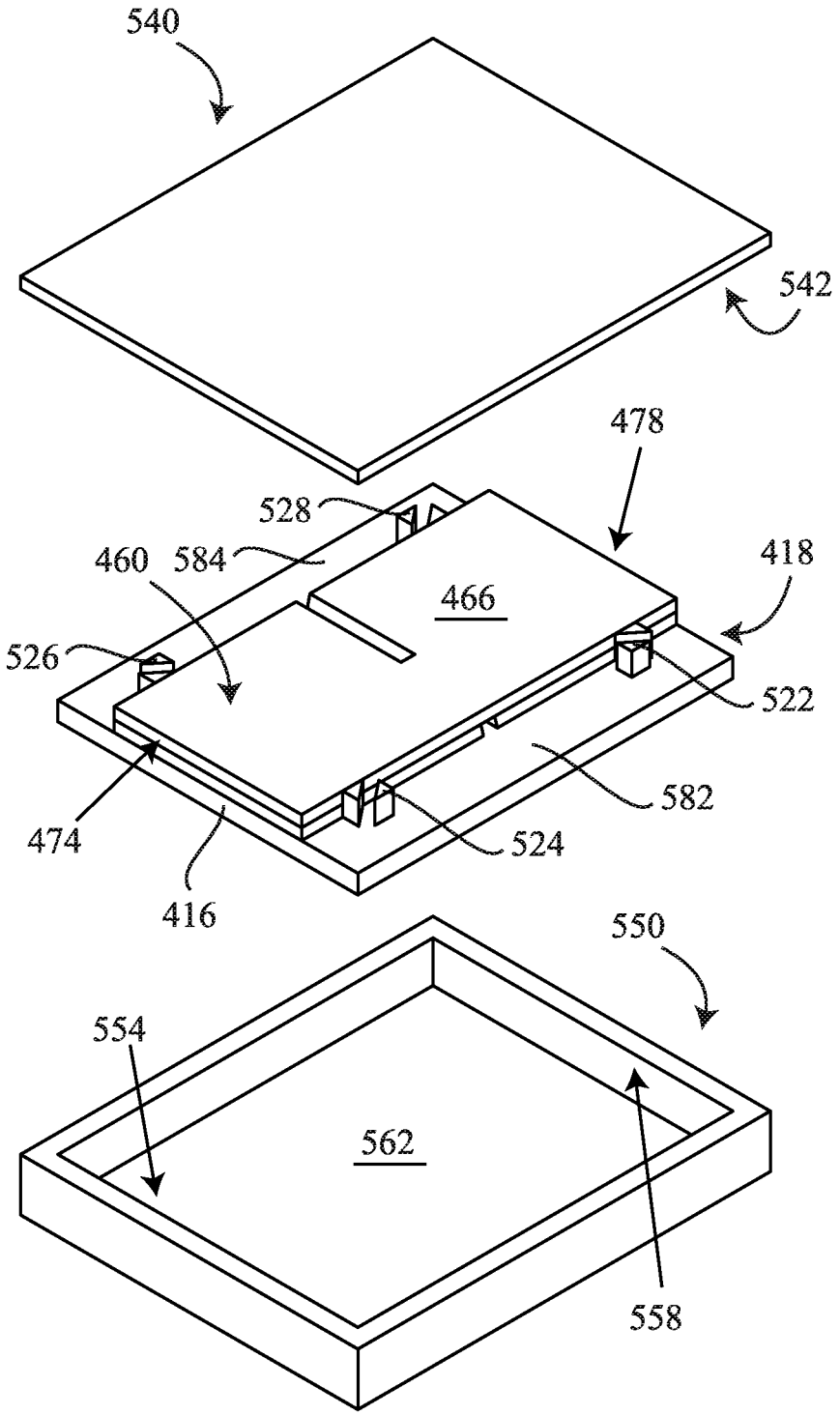
FIG. 5 is a schematic perspective view of the portable standing desk device of FIG. 4 in the storage condition before storing into a storage case in examples of the present disclosure.

FIG. 5 is a schematic perspective view of the portable standing desk device of FIG. 4 in the storage condition before storing into a storage case in examples of the present disclosure. A first surface (bottom surface 468) of the base panel stack 460 contacts the bottom surface 114 of the top board 110.

In examples of the present disclosure, a height of the four separated block assemblies 122, 124, 126, and 128 is twice of a thickness of the base panel 160 or the base panel 180. In the storage condition, bottom surfaces 522, 524, 526, and 528 of the four separated block assemblies 122, 124, 126, and 128 and a second surface (top surface 466) of the base panel stack 460 are co-planar. After placing the base panel stack 460 in a storage case 550 and covered by a storage cover 540, the bottom surfaces 522, 524, 526, and 528 of the four separated block assemblies 122, 124, 126, and 128 and the top surface 466 of the base panel stack 460 contact a bottom surface 542 of the storage cover 540.

In examples of the present disclosure, in the storage condition, a third surface 472 of the base panel stack 460 contacts a side surface 422 of the first block assembly 122 and a side surface 424 of the second block assembly 124. A fourth surface 476 of the base panel stack 460 contacts a side surface 426 of the third block assembly 126 and a side surface 428 of the fourth block assembly 128. In one example, a distance between the side surface 424 and the side surface 426 is the same as the length of a fifth surface 474 of the base panel stack 460 (a height of the base panel 160 or the base panel 180). The fifth surface 474 of the base panel stack 460 and a first side surface 416 of the top board 110 are co-planar. A sixth surface 478 of the base panel stack 460 and a second side surface 418 of the top board 110 are co-planar. After placing the base panel stack 460 in the storage case 550 and covered by the storage cover 540, the fifth surface 474 of the base panel stack 460 and the first side surface 416 of the top board 110 contact a side surface 554 of the storage case 550. The sixth surface 478 of the base panel stack 460 and the second side surface 418 of the top board 110 contact a side surface 558 of the storage case 550.

Figure 6:
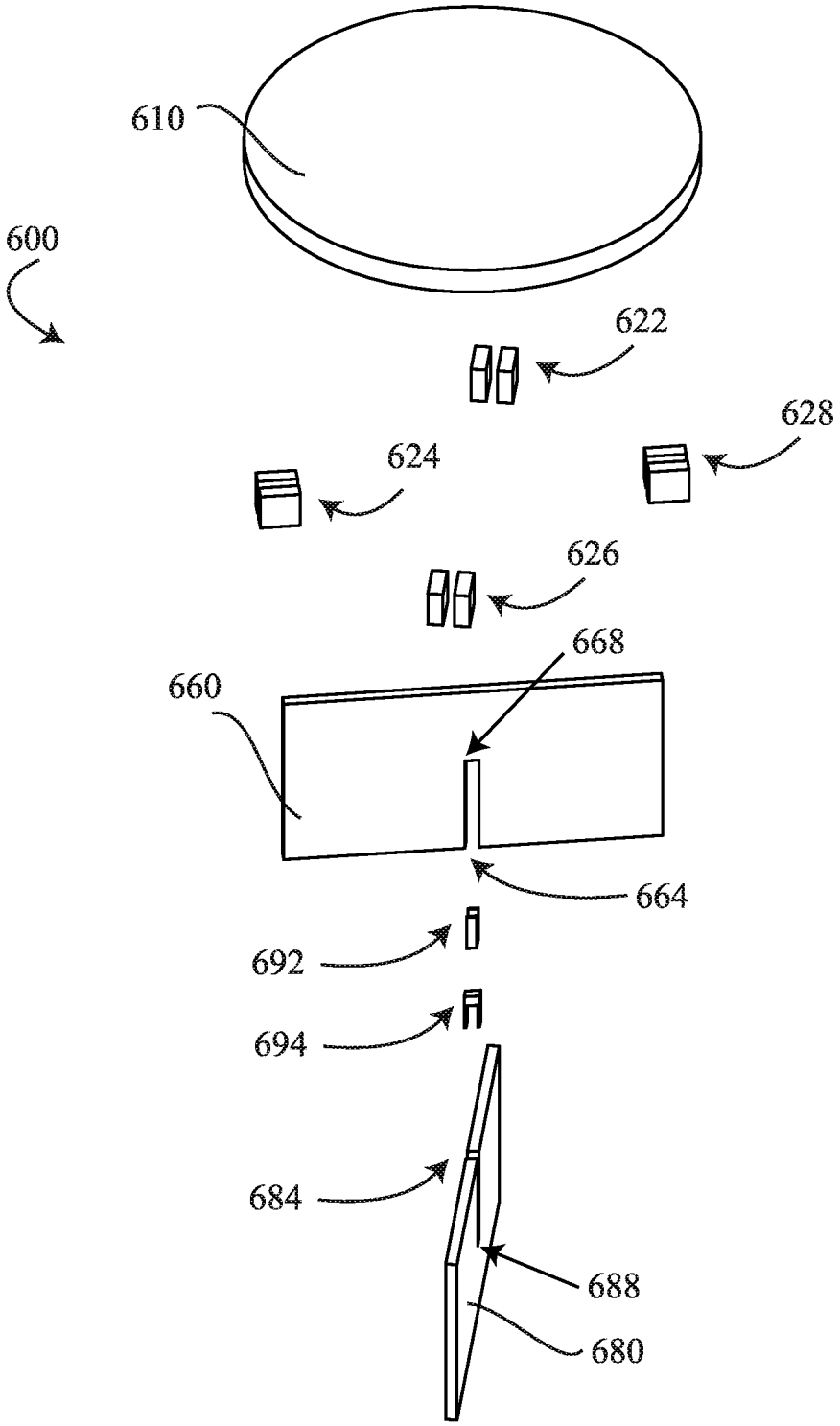
FIG. 6 is an exploded view of another portable standing desk device in examples of the present disclosure.
Figure 7:
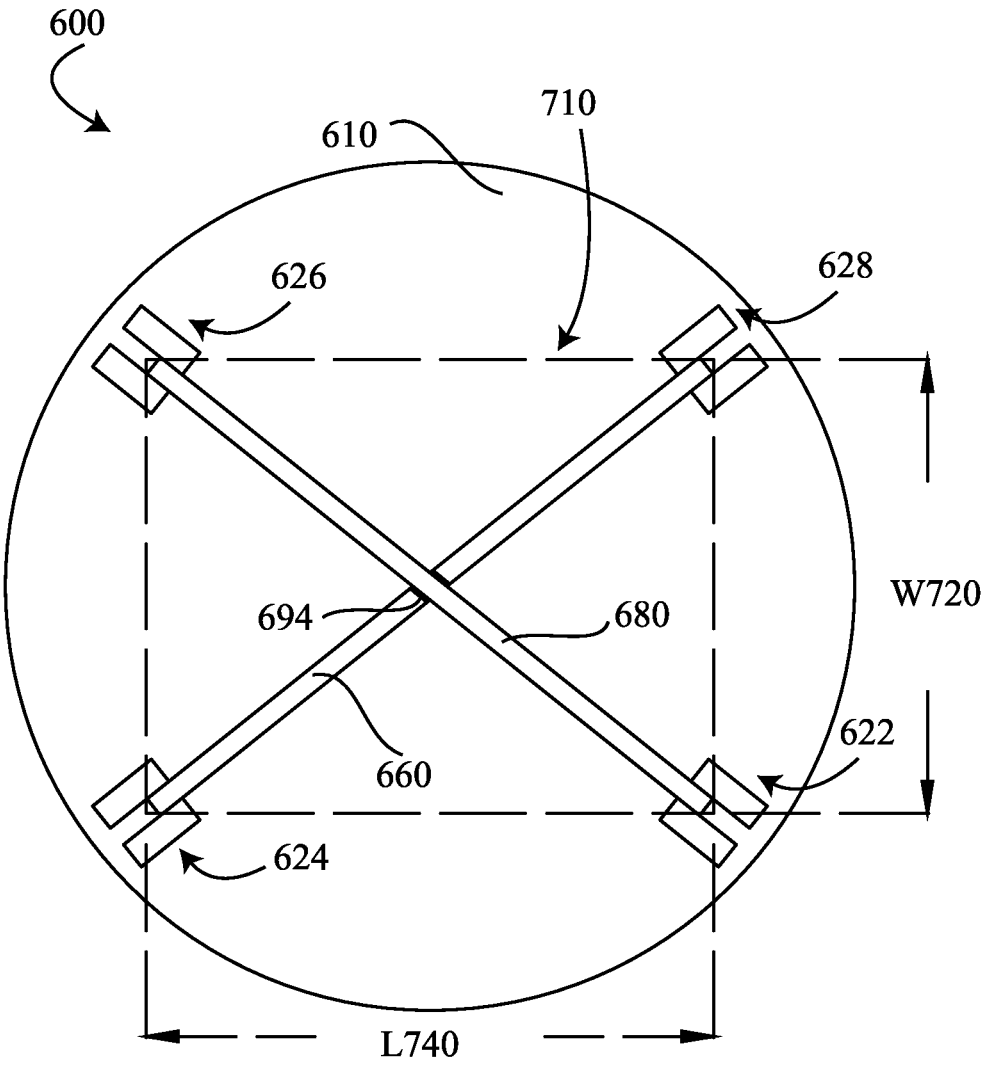
FIG. 7 is a bottom view of the portable standing desk device of FIG. 6 in examples of the present disclosure.

FIG. 6 is an exploded view and FIG. 7 is a bottom view of another portable standing desk device 600 in examples of the present disclosure. The portable standing desk device 600 comprises a top board 610, a first block assembly 622, a second block assembly 624, a third block assembly 626, a fourth block assembly 628, a first U-shaped reinforcing element 692, a second U-shaped reinforcing element 694, a first base panel 660, and a second base panel 680. Top surfaces of the first block assembly 622, the second block assembly 624, the third block assembly 626, and the fourth block assembly 628 are attached to the top board 610. The first base panel 660 has an open ended slot 664 extending upwardly from a bottom surface of the first base panel 660. The second base panel 680 has an open ended slot 684 extending downwardly from a top surface of the second base panel 680. The first U-shaped reinforcing element 692 is attached to an end 668 of the first open ended slot 664 and the second U-shaped reinforcing element 694 is attached to an end 688 of the second open ended slot 684. In examples of the present disclosure, the first U-shaped reinforcing element 692 is symmetric with respect to a symmetry plane parallel to legs of the U-shape.

In examples of the present disclosure, in an assembled condition, a bottom surface of the first U-shaped reinforcing element 692 contacts a top surface of the second U-shaped reinforcing element 694.

In FIG. 7, a center of a first groove of the first block assembly 622, a center of a second groove of the second block assembly 624, a center of a third groove of the third block assembly 626, and a center of a fourth groove of the fourth block assembly 628 are located at four corners of an imaginary rectangle 710. The imaginary rectangle 710 has a length L740 and a width W720. A slenderness ratio of the imaginary rectangle 710 is represented by the length L740 divided by the width W720. In examples of the present disclosure, four ends of the first and second base panels 660 and 680 are located in the four grooves of the four separated block assemblies 622, 624, 626, and 628. In another examples, in FIG. 3, four ends of the first and second base panels 160 and 180 are located beyond the four grooves 132, 134, 136, and 138 of the four separated block assemblies 122, 124, 126, and 128.

Figure 8:
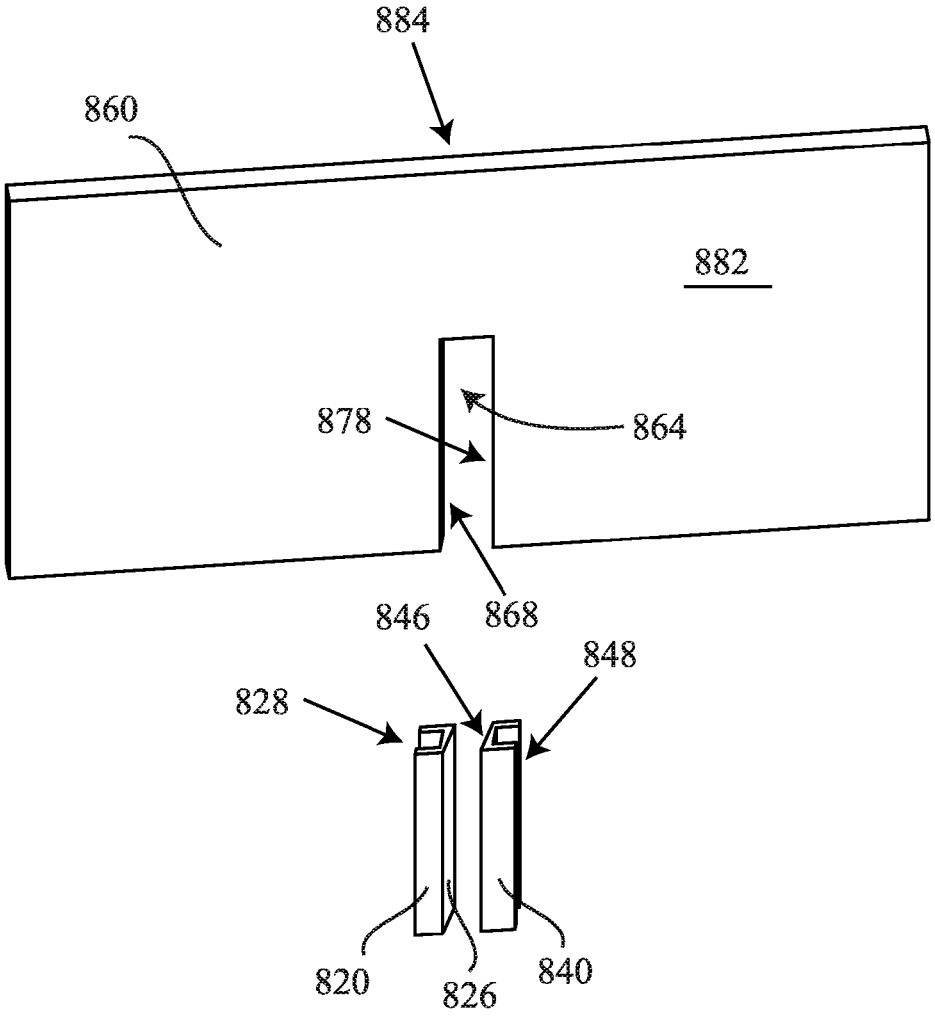
FIG. 8 is a schematic perspective view of a base panel and two angle adjusters of a portable standing desk device in examples of the present disclosure.

FIG. 8 is a schematic perspective view of a base panel 860 and two angle adjusters 820 and 840 of a portable standing desk device in examples of the present disclosure. Surface 826 and surface 828 are not parallel to each other. Surface 846 and surface 848 are not parallel to each other. After integration of the two angle adjusters 820 and 840 with the base panel 860, a surface 868 of an open ended slot 864 contacts the surface 828. A surface 878 of an open ended slot 864 contacts the surface 848. Inner side surfaces of the angle adjuster 820 contact front and back surfaces 882 and 884 of the base panel 860. Inner side surfaces of the angle adjuster 840 contact the front and back surfaces 882 and 884 of the base panel 860.

In examples of the present disclosure, the base panel 160 and the base panel 180 of FIGS. 1-3 are assembled with another top plate (for example, top board 610 of FIGS. 6 and 7) having another set of four block assemblies (for example, a first block assembly 622, a second block assembly 624, a third block assembly 626 and a fourth block assembly 628 of FIGS. 6 and 7). Each of the base panels 160 and 180 is coupled with two angle adjusters 820 and 840 of FIG. 8. Centers of the four grooves of the other set of the four block assemblies are located at four corners of another imaginary rectangle respectively. Another acute angle between the normal direction of the first side surface of the first base panel 160 and a first side wall of the first angle adjuster 820 is determined by substitution of a slenderness ratio of the second imaginary rectangle into the mathematical expression $\{2\times[\text{arctangent}(L/W)\times180/\pi]-90\}$. In examples of the present disclosure, the other acute angle is larger than the acute angle A360.

In examples of the present disclosure, in a storage condition, the first U-shaped reinforcing element 692, the second U-shaped reinforcing element 694, and the two angle adjusters 820 and 840 are stored in the regions 582 and 584 of FIG. 5.

Those of ordinary skill in the art may recognize that modifications of the embodiments disclosed herein are possible. For example, the shape and the size of the block assemblies may vary. Other modifications may occur to those of ordinary skill in this art, and all such modifications are deemed to fall within the purview of the present invention, as defined by the claims.

The invention claimed is:

1. A portable standing desk device comprising:

a first top board having a top surface and a bottom surface opposite the top surface;

a first set of four separated block assemblies attached to the bottom surface of the first top board, the first set of the four separated block assemblies including a first block assembly having a first groove;

a second block assembly having a second groove;

a third block assembly having a third groove; and a fourth block assembly having a fourth groove;

a center of the first groove, a center of the second groove, a center of the third groove, and a center of the fourth groove being located at four corners of a first imaginary rectangle, the first groove and the third groove being diagonally opposed, the second groove and the fourth groove being diagonally opposed;

a first base panel having a first open ended slot extending upwardly from a bottom surface of the first base panel; and a second base panel having a second open ended slot extending downwardly from a top surface of the second base panel;

wherein the portable standing desk device is characterized by a first assembled condition in which the first and second base panels are interlocked so as to form a base having a letter X shape;

a top surface of the first base panel and the top surface of the second base panel contact the bottom surface of the first top board;

portions of the top surface of the first base panel are in the first and third grooves respectively; and portions of the top surface of the second base panel are in the second and fourth grooves respectively; and a storage condition in which a first side surface of the first base panel contacts a second side surface of the second base panel so as to form a base panel stack; and wherein a first acute angle in degrees between a normal direction of the first side surface of the first base panel and a first side wall of the first open ended slot is determined by a mathematical expression $\{2\times[\text{arctangent}(L/W)\times180/\pi]-90\}$;

wherein L is a length of the first imaginary rectangle;

W is a width of the first imaginary rectangle;

L/W is a slenderness ratio of the first imaginary rectangle;

L is larger than W;

$\pi$ is a mathematical constant, a ratio of a circle's circumference to a diameter of the circle; and arctangent is an inverse trigonometric function.

2. The portable standing desk device of claim 1, wherein a length of the first open ended slot is longer than a half of a height of the first base panel and a length of the second open ended slot is longer than a half of a height of the second base panel.

3. The portable standing desk device of claim 1 further comprising a second top board having a top surface and a bottom surface opposite the top surface;

a second set of four separated block assemblies attached to the bottom surface of the second top board, the second set of the four separated block assemblies including a fifth, sixth, seventh, and eighth block assemblies having a fifth, sixth, seventh, and eighth grooves respectively, centers of the fifth, sixth, seventh, and eighth grooves being located at four corners of a second imaginary rectangle respectively;

a first, second, third, and fourth angle adjusters;

wherein the portable standing desk device is further characterized by a second assembled condition in which the first and second angle adjusters are attached to the first and a second side walls of the first open ended slot;

the third and fourth angle adjusters are attached to a third and fourth side walls of the second open ended slot;

the first and second base panels are interlocked so as to form a base having a letter X shape;

portions of the top surface of the first base panel are in the fifth and seventh grooves respectively; and portions of the top surface of the second base panel are in the sixth and eighth grooves respectively.

4. The portable standing desk device of claim 3, wherein a second acute angle between the normal direction of the first side surface of the first base panel and a first side wall of the first angle adjuster is determined by substitution of a slenderness ratio of the second imaginary rectangle into the mathematical expression.

5. The portable standing desk device of claim 4, wherein the second acute angle is larger than the first acute angle.

6. The portable standing desk device of claim 1 further comprising a first and second angle adjusters attached to a first and second side walls of the first open ended slot and a third and fourth angle adjusters attached to a third and fourth side walls of the second open ended slot.

7. The portable standing desk device of claim 1, wherein the portable standing desk device is further characterized by the first assembled condition in which the portions of the top surface of the first base panel are press-fitted into the first and third grooves respectively; and the portions of the top surface of the second base panel are press-fitted into the second and fourth grooves respectively.

8. The portable standing desk device of claim 1, wherein each of the first, second, third and fourth block assemblies is a two-piece constructed assembly having a first and second pieces and wherein the first and second pieces of each of the first, second, third and fourth block assemblies are separated by a corresponding groove of the first, second, third and fourth grooves.

9. The portable standing desk device of claim 1, wherein each of the first, second, third and fourth block assemblies is a one-piece constructed assembly having a single piece;

wherein the single piece of each of the first, second, third and fourth block assemblies has a corresponding groove of the first, second, third and fourth grooves in a middle region thereof; and wherein the corresponding groove faces downwardly.

10. A portable standing desk device comprising:

a first top board having a top surface and a bottom surface opposite the top surface;

a first set of four separated block assemblies attached to the bottom surface of the first top board, the first set of the four separated block assemblies including a first block assembly having a first groove;

a second block assembly having a second groove;

a third block assembly having a third groove; and a fourth block assembly having a fourth groove;

a center of the first groove, a center of the second groove, a center of the third groove, and a center of the fourth groove being located at four corners of a first imaginary rectangle, the first groove and the third groove being diagonally opposed, the second groove and the fourth groove being diagonally opposed;

a first base panel having a first open ended slot extending upwardly from a bottom surface of the first base panel; and a second base panel having a second open ended slot extending downwardly from a top surface of the second base panel;

wherein the portable standing desk device is characterized by a first assembled condition in which the first and second base panels are interlocked so as to form a base having a letter X shape;

a top surface of the first base panel and the top surface of the second base panel contact the bottom surface of the first top board;

portions of the top surface of the first base panel are in the first and third grooves respectively; and portions of the top surface of the second base panel are in the second and fourth grooves respectively; and a storage condition in which a first side surface of the first base panel contacts a second side surface of the second base panel so as to form a base panel stack;

wherein a height of the first set of four separated block assemblies is twice of a thickness of the first or second base panel; and wherein the portable standing desk device is further characterized by the storage condition in which a first surface of the base panel stack contacts the bottom surface of the first top board;

a second surface of the base panel stack and bottom surfaces of the first set of four separated block assemblies are co-planar;

the second surface of the base panel stack is opposing the first surface of the base panel stack;

a third surface of the base panel stack contacts a side surface of the first block assembly and a side surface of the second block assembly;

a fourth surface of the base panel stack contacts a side surface of the third block assembly and a side surface of the fourth block assembly; and the fourth surface of the base panel stack is opposing the second surface of the base panel stack.

11. The portable standing desk device of claim 10, wherein the portable standing desk device is further characterized by the storage condition in which a fifth surface of the base panel stack and a first side surface of the first top board are co-planar;

a sixth surface of the base panel stack and a second side surface of the first top board are co-planar;

the sixth surface of the base panel stack is opposing the fifth surface of the base panel stack; and the second side surface of the first top board is opposing the first side surface of the first top board.

12. A portable standing desk device comprising:

a first top board having a top surface and a bottom surface opposite the top surface;

a first set of four separated block assemblies attached to the bottom surface of the first top board, the first set of the four separated block assemblies including a first block assembly having a first groove;

a second block assembly having a second groove;

a third block assembly having a third groove; and a fourth block assembly having a fourth groove;

a center of the first groove, a center of the second groove, a center of the third groove, and a center of the fourth groove being located at four corners of a first imaginary rectangle, the first groove and the third groove being diagonally opposed, the second groove and the fourth groove being diagonally opposed;

a first base panel having a first open ended slot extending upwardly from a bottom surface of the first base panel; and a second base panel having a second open ended slot extending downwardly from a top surface of the second base panel;

wherein the portable standing desk device is characterized by a first assembled condition in which the first and second base panels are interlocked so as to form a base having a letter X shape;

a top surface of the first base panel and the top surface of the second base panel contact the bottom surface of the first top board;

portions of the top surface of the first base panel are in the first and third grooves respectively; and portions of the top surface of the second base panel are in the second and fourth grooves respectively; and a storage condition in which a first side surface of the first base panel contacts a second side surface of the second base panel so as to form a base panel stack; and wherein a first U-shaped reinforcing element is attached to an end of the first open ended slot and a second U-shaped reinforcing element is attached to an end of the second open ended slot.

13. The portable standing desk device of claim 12, wherein the portable standing desk device is further characterized by the first assembled condition in which a bottom surface of the first U-shaped reinforcing element contacts a top surface of the second U-shaped reinforcing element.

* * * * *